United States Patent [19]

Newberry et al.

[11] 4,282,839

[45] Aug. 11, 1981

[54] BREAKERLESS MAGNETO IGNITION SYSTEM

[75] Inventors: Richard D. Newberry, Springfield; Elwin J. Brayley, East Longmeadow, both of Mass.

[73] Assignee: Eltra Corporation, Toledo, Ohio

[21] Appl. No.: 898,279

[22] Filed: Apr. 20, 1978

[51] Int. Cl.[3] ..... F02D 3/08

[52] U.S. Cl. ..... 123/335; 123/418; 123/602

[58] Field of Search ..... 123/148 CC, 148 AC, 123/149 R, 149 A, 149 C, 149 D; 310/704; 315/218

[56] References Cited

U.S. PATENT DOCUMENTS

| | | | |
|---|---|---|---|
| 3,358,665 | 12/1967 | Carmichael et al. | 123/148 CC |
| 3,398,353 | 8/1968 | Noddin et al. | 322/17 |
| 3,405,347 | 10/1968 | Swift et al. | 322/91 |
| 3,484,677 | 12/1969 | Pieto | 123/148 E X |
| 3,958,546 | 5/1976 | Ohki et al. | 123/148 E |
| 4,120,277 | 10/1978 | Ehlen | 123/148 CC |
| 4,144,859 | 3/1979 | Ohki et al. | 123/148 E X |

*Primary Examiner*—Tony M. Argenbright

*Attorney, Agent, or Firm*—James P. DeClercq; Joel I. Rosenblatt

[57] ABSTRACT

A breakerless magneto ignition system for an internal combustion engine, having an inherent speed limiting feature is disclosed. The ignition system includes an ignition coil with primary and secondary windings, a drive winding and a trigger winding. A first solid state switch is placed in circuit with the primary winding for controlling current flow through the primary winding, the drive winding controlling the solid state switch to render it conductive to allow current flow through the primary winding, and the trigger winding and an associated switching circuit subsequently shunting the input to the first solid state switch to render it nonconductive, to block current flow through the primary coil and induce an ignition spark voltage in the secondary winding. The primary winding, secondary winding and drive winding are mounted on the same magnetic frame adjacent a magnet-containing flywheel, and the trigger coil is mounted on the lower edge of the secondary winding in close proximity to the flywheel. The primary winding current generates a field that interacts with the trigger winding to produce a premature pulse which increases in magnitude to prematurely activate the first solid state switch at a high engine RPM, at a point in the engine cycle at which there is insufficient current flow in the primary coil to produce an effective ignition spark voltage.

12 Claims, 4 Drawing Figures

BREAKERLESS MAGNETO IGNITION SYSTEM

BACKGROUND OF THE INVENTION

This invention relates to magneto ignition systems for small internal combustion engines of the type having a magnet in the flywheel or rotor that is driven in synchronism with the engine operation to generate the ignition spark through a primary and secondary winding coil arrangement in which the magnet generates primary current.

In a typical magneto ignition system of this type, the rotation of the rotor causes the magnet to induce a current in a primary winding that is located adjacent to the rotor or flywheel. This current flow is controlled by a switch device which allows the current to flow as the field from the rotor increases and which stops the current flow abruptly at a particular point in the engine cycle at which time a self-induced primary winding voltage is established. This produces a larger voltage, the ignition spark, upon a secondary winding that is electromagnetically coupled to the primary winding. In general, the spark voltage is related to the primary winding voltage in proportion to the turns ratio between the primary and secondary windings.

One form of a switch commonly used to control the primary winding current is simply a breakerpoint that is operated through the engine crankshaft to open and close at the proper times in the engine cycle to turn the current ON and OFF. At the time of opening, however, the self-induced primary winding voltage, which can be on the order of 400 volts or more, appears across the points, and despite the use of capacitors, there is gradual erosion or pitting of the contact surfaces. In addition, the rubbing block or interconnecting hardware between the breakerpoints and the engine output shaft also undergoes gradual wear. The wear and the point erosion can cause a gradual change in engine ignition timing and this gradual change in timing can result in loss of power and deteriorated fuel economy.

Consequently, semiconductor switch devices are also used to substitute for the breakerpoint arrangement since they are not subject to those mechanical problems. The function remains the same, however: to turn the primary winding current ON and OFF at the proper times during the engine cycle so as to produce the spark at or near the top of the compression stroke. It is also desired that the necessary advance characteristics for efficient engine combustion be provided. Proper switching requires that the primary current be allowed to build as the magnet field increases in the primary winding and that it is turned OFF near its maximum level so as to generate the largest possible ignition spark.

A transistor switch, however, is resistive and therefore tends to lower the maximum current flow in the primary circuit. Its resistance can be minimized, of course, by driving the transistor into saturation. But there is the problem, however, with those devices where the transistor switch is controlled by a bleed resistor between the collector and base input. The bleed resistor produces a voltage drop between the collector and base to insure operation of the transistor in its active region. But the result of this voltage drop is that the saturation voltage of the transistor is raised, which thereby reduces the primary winding current.

Some approaches attempt to avoid this problem by using a separate coil to generate the base drive for the transistor switch. In particular, the base drive coil is connected between the base and emitter of the transistor switch and produces a voltage in response to the flywheel rotation to place the switch in the active state to allow a current flow, that occurs in a phase relationship with the primary winding current since the base drive coil is wound on the same magnetic frame with the primary winding. This is also necessary to insure that the primary winding current reaches its maximum level. A problem associated with this arrangement, however, is that the coil must be constructed so as to have the capability to supply the necessary current from the magnet to excite the transistor into a saturated conducted state, which as mentioned previously, is necessary to achieve the maximum possible current flow. A power transistor is normally used and these are characterized by an extremely low base to emitter current gain characteristic. The need for a power transistor arises simply from the fact that the primary winding current can be comparatively high, for example, several amperes. Because of a power transistor's extremely low current gain characteristic, however, the base drive coil must be constructed to produce a significant amount of current. Thus the windings can be significantly large, which increases the overall size of the ignition system.

In other applications, a gate-turn off device is used instead of the simple power transistor. The advantage of the gate turn off device is its low active voltage drop which therefore maximizes the primary winding current. With this device, the bias winding is connected to the gate and the bias winding voltage generating the gate current to turn the switch ON, which allows the current to flow through the primary winding. When the bias winding output voltage drops below a particular negative level, the gate current is suddenly reversed which turns the switch OFF and thereby abruptly stops the current flow which produces the ignition spark in the same way discussed above.

The gate controlled switch, however, possesses some undesirable characteristics. Among these characteristics is that the current gain relationship between the gate input and the anode-cathode output, is such that more current is needed to turn the switch OFF than is needed to turn it ON. Consequently, the current gain, when the switch is conducting is much smaller than the current gain when the switch is not conducting. Because of this, the bias coil must be designed to have sufficient capability to supply the necessary current to turn the device off. The bias coil, therefore, is rendered somewhat larger than it might otherwise have to be if the current gain characteristics were uniform. The ignition system is thus larger also.

SUMMARY OF THE INVENTION

In the present invention, a Darlington current amplifier, consisting of at least two transistors, controls the current flow through the primary winding. This current amplifier consequently has very high and uniform current gain characteristics between its base input and its collector to emitter output. A separate drive winding drives the amplifier into saturation and, due to the amplifier's high gain characteristics, the drive winding is small. The voltage output from the drive winding is in phase with the primary winding voltage for the reason that both are wound on the same magnetic frame stator and thus, they share the same flux from the flywheel magnet that is housed in this engine flywheel. The drive winding is coupled through a diode to the base input of the Darlington and thus the amplifier is driven into saturation, as soon as the driver output exceeds the combined voltage drop of the diode junction and the base-emitter junctions of the two transistors. This, combined with the inphase relationship between the primary and drive voltages allows the primary current to increase to the maximum possible level as the flywheel is rotated.

A trigger winding which is mounted on the edge of the secondary and drive windings receives magnetic flux from the flywheel magnet independently from the stator. This produces a voltage output from the trigger winding that actuates a silicon controlled rectifier to its conductive state. The amplifier responds to the voltage across the rectifier output which is connected to the drive winding output. When the rectifier is conductive, its output circuit voltage drop is less than the voltage needed to turn the amplifier ON and thus it pulls the amplifier input below this voltage, thereby turning the amplifier OFF. This stops the current flow through the amplifier and produces a self-induced primary voltage which generates the spark pulse at the secondary voltage.

As the engine r.p.m. increases, the trigger coil voltage output reaches the SCR trigger voltage earlier in time for the reason that the rate of change in the flux from the flywheel is larger. As a result of this, there is a smooth and gradual ignition advance.

There is a deliberate interaction between the field produced by the primary winding current flow and the trigger coil. This field generates a small pulse in the trigger coil output in advance of the voltage pulse from the trigger coil that triggers the SCR. At low r.p.m., this pulse is at a level which is insufficient to trigger the SCR into its conductive state. At a particular high r.p.m., however, this pulse triggers the SCR into the conductive state. This occurs well in advance of the point at which there is sufficient primary winding current flow to establish the necessary ignition spark for sustained engine operation, and consequently, the engine cannot operate at or above this r.p.m.

The current flow from the drive winding into the amplifier is controlled by a resistor. When the primary winding current flow is stopped, energy is transferred from the primary winding to the secondary and drive windings. This energy produces a current flow in the drive winding that flows through the SCR which remains conductive until there is no drive winding voltage. The magnitude of the resistor determines the amount of the current flow in the drive winding induced by the primary winding field, which thereby determines the amount of energy which is transferred to the secondary winding and the maximum obtainable secondary voltage.

Thus, an object of the present invention is to provide an extremely compact breakerless magneto which can be placed, as a single sealed unit, adjacent to the flywheel of a small internal combustion engine, and which produces the spark with minimum circuit electrical losses.

Other objects of the present invention include: providing an ignition system which prevents excessive engine r.p.m., and which regulates the open circuit secondary voltage so as to prevent damage to the magneto structure; providing an ignition system in which the necessary components are as small as possible by maximizing the efficiency of the system components so as to achieve an extremely small and economical ignition system and one that is easy to fabricate and readily adaptable for varying engine installations.

The foregoing, as well as other objects, features and benefits of this invention will be apparent to those skilled in the art from the following drawing, detailed description and claims.

DESCRIPTION OF THE DRAWING

FIG. 4 shows the output wave forms for the trigger coil and primary winding current at normal r.p.m., and at and above which the ignition system provides automatic governing.

DETAILED DESCRIPTION

Figure 1:
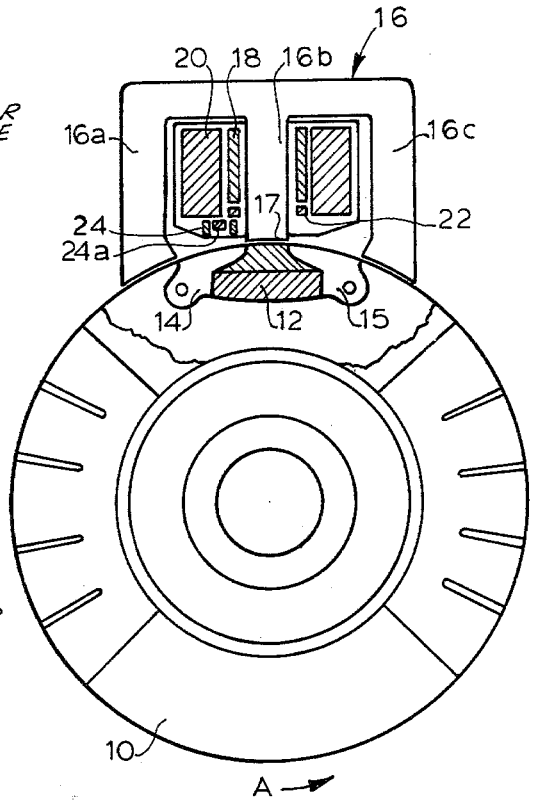
FIG. 1 shows the various coil windings of the present invention in cross section on a three legged stator structure in a position adjacent to a typical flywheel that is mounted on the crank shaft of an internal combustion engine. A portion of the flywheel is cutaway to expose the magnet and pole shoes.

Proceeding now with the detail of the operation of the present invention, reference is made first to FIG. 1, where a typical installation of a magneto employing the present invention is shown on an engine. The engine flywheel, designated 10, is mounted on the engine crankshaft and is rotated in the direction shown by arrow A. Flywheel 10 contains a magnet designated 12, that is located in the interior of the flywheel 10, and adjacent to each edge of magnet 12 there are pole shoes 14, 15, extending radially outward from the edge of flywheel 10. These shoes 14, 15 are constructed of laminations of high permeability material and serve to deflect or orient the field lines from the magnet in a substantially radial direction, and so, the lines can be perceived to originate from one end of the magnet 12, passing through shoe 14 in the radial direction and then bend slowly in a circular direction to enter shoe 15 and terminate in the opposite end of the magnet 12.

Located adjacent to flywheel 10 is a magnetic stator frame designated 16 having three legs **16*a*, 16*b* and 16*c* extending into close proximity to the edge of flywheel 10. The air gap 17 between the legs 16*a*, 16*b*, 16*c* and flywheel 10 should be as small as possible to minimize field losses between the pole shoes 14, 15 and the stator frame 16**.

A first winding 18, hereinafter referred to as the primary winding, is wound around the center core leg **16*b*. Wound concentrically around primary winding 18 is the secondary winding 20 which produces ignition spark across gap 25. Also wound around the center leg 16*b* is a third winding hereinafter designated the drive or bias winding 22. Both the secondary winding 20 and drive winding 22 are magnetically coupled to the primary winding 18 due to their close distal relationship. Moreover, by reason of their common concentric position on leg 16*b*, the primary and secondary drive windings 18, 22 are penetrated by the same magnetic flux in the stator frame 16 and thus the voltages that are induced in each winding, 18, 22 as flywheel 10** rotates are in phase.

Figure 2:
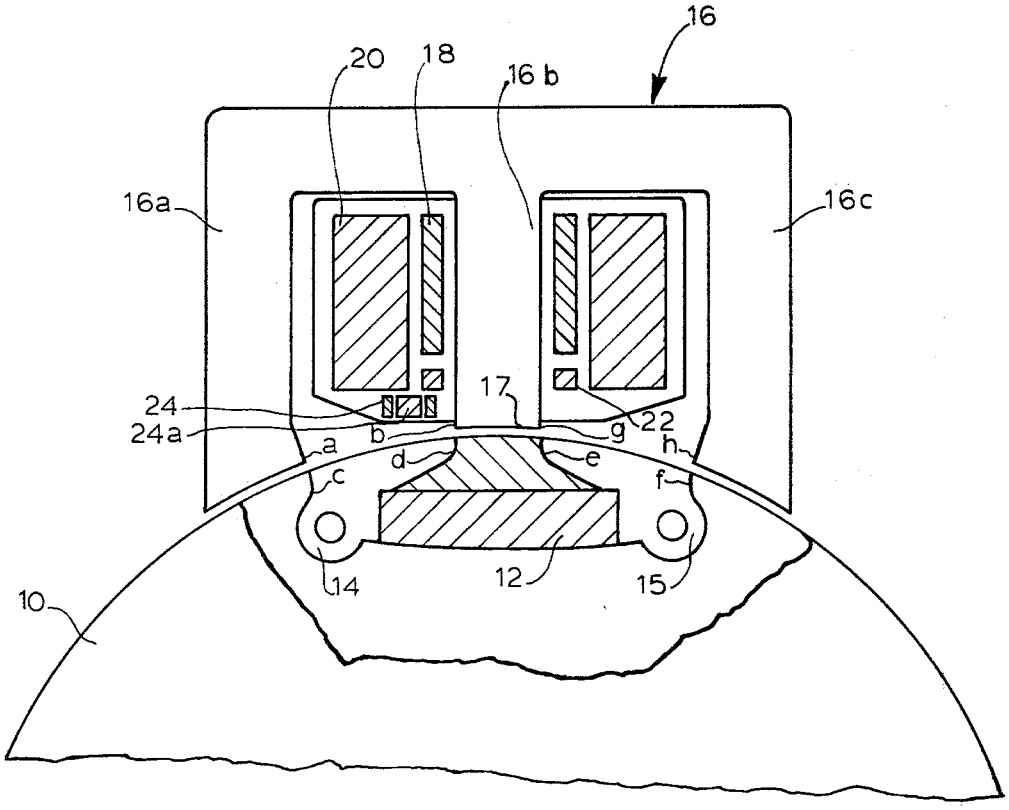
FIG. 2 is an enlargement of the flywheel and magnet piece, and the windings and stator frame shown in FIG. 2, so as to show more clearly, their positional and dimensional relationships.

The size of the windings 18, 20, 22 depicted in the cross sections in FIG. 1 and FIG. 2 represents the relative number of turns in each winding. Secondary winding 20 is thus larger than the primary winding 18 since it must have many more turns than primary winding 18 to provide the needed transformer relationship to generate the ignition spark from the self-induced primary voltage. Drive winding 22 produces a small signal and thus is small as shown.

A fourth coil, hereinafter referred to as trigger coil 24, is located on the lower edge of secondary winding 20 and drive winding 22, in close proximity to flywheel 10 so that the field from pole shoes 14, 15 penetrate it as flywheel 10 rotates. A core 24*a* of high permeability material is provided for the purpose of intensifying the field. Trigger coil 24 and primary winding 18 are comparatively close to each other, as it can be seen, and as a result, the field produced by the high primary current penetrates trigger coil 24. As discussed in greater detail below, this produces the automatic governing control of the present invention. Although there is some interaction with the drive winding 22 and secondary winding 20, the lower current levels in these windings produce much smaller fields, having no noticeable effect on the performance of the ignition system.

As flywheel 10 rotates in the direction of arrow A the field flux that passes between pole shoe 14 and pole shoe 15 produces the maximum flux density in leg 16*b* when pole shoe 14 is essentially directly opposite leg 16*b* and pole shoe 15 accordingly is essentially opposite leg 16*c*. Likewise, there is maximum flux density in 16*b*, but in the opposite direction when the flywheel 10 is rotated, so that shoe 14 is opposite leg 16*a* and shoe 15 is opposite leg 16*b*. These changes in flux density and direction in stator frame 16 and, more precisely in leg 16*b*, induces voltages in primary winding 18 and drive winding 22 for the generation of the ignition spark in the manner discussed below.

At this juncture it should be observed that the field in stator frame 16 is concentrated in the frame and does not interact with trigger coil 24. The field magnet 12, however, penetrates the trigger coil 24 and produces the main trigger pulse for controlling the point in the engine cycle at which the spark occurs.

Figure 4:
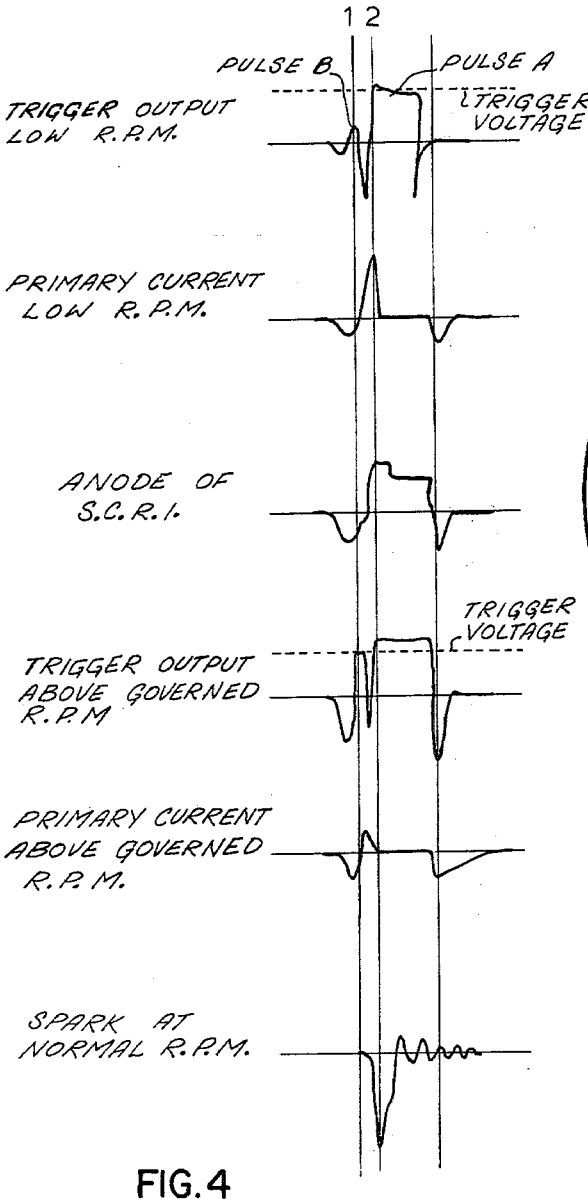
FIG. 4 shows the wave forms for the trigger coil, primary winding and secondary output with respect to particular points in the flywheel cycle.

Referring now to FIG. 2, the structure of the various windings with respect to each other is shown in greater detail. It should be observed that the distance between the edges A & B on stator leg 16*a* should be ostensibly equal to the distance between edges C & D on pole shoe 14. Likewise, these distances are also the same as the distances between edges E & F on pole shoe 15 and the distance between edges G & H on legs 16*b* and 16*c*. In other words, the width of the pole shoes should be substantially the same as the distance between the stator legs. This has been found to be desirable to insure that the wave forms shown in FIG. 4 are produced.

Figure 3:
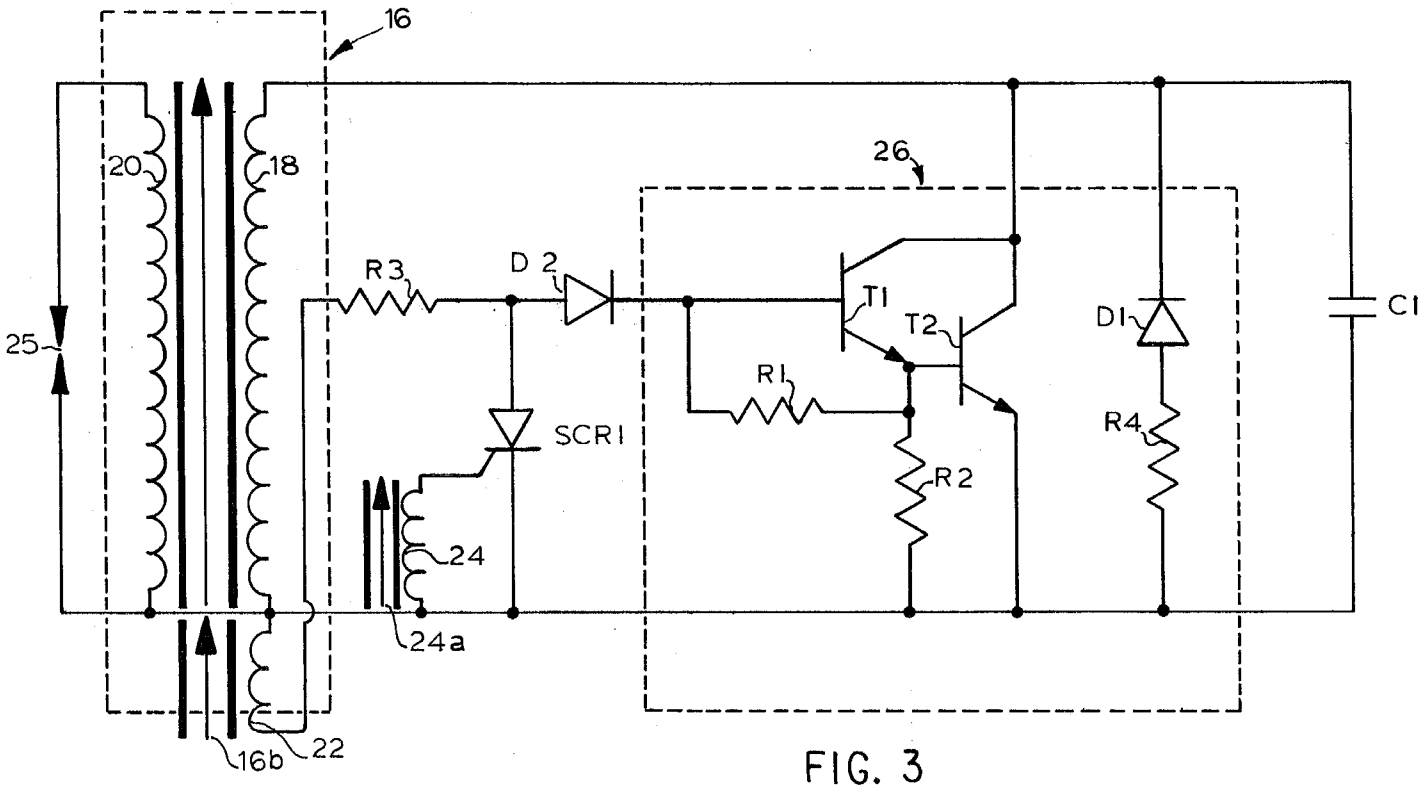
FIG. 3 is an electrical schematic of the ignition system of the present invention.

Turning now to FIG. 3, it can be observed once again, that primary 18, secondary winding 20 and drive winding 22 are wound upon and magnetically coupled to each other through stator leg 16*b*. The dotted line, desingated 16, corresponds to the stator frame. The output terminals from secondary winding 20 are connected to spark gap 25, corresponding, for illustrative purposes, to the engine spark plug, across which the induced secondary output generates the high tension voltage for ignition spark for fuel combustion for sustained engine operation. One output terminal of primary winding 18 is coupled to ground and likewise one terminal of secondary winding 20, drive winding 22 and trigger coil 24 is connected to ground. The output from primary winding 18 is connected across the collector and emitter junctions of a Darlington transistor amplifier designated 26, which includes at least two transistors T1, T2, thereby giving amplifier 26 an extremely high current gain characteristic between the base of transistor T1 and the output transistor T2. Resistors R1 and R2 provide leakage current between the collector and base junctions of transistors T1 and T2 to maximize the transistor cutoff voltage. The cutoff voltage of T1 and T2 determines the maximum obtainable primary voltage. Hence, increasing the cutoff voltage increases the primary voltage and the spark voltage it produces at the secondary voltage. Also connected across the collector and emitter junctions of amplifier 26 is a diode D1 to accommodate reverse primary current at certain points in the engine cycle.

The output of drive winding 22 is fed to the base of T1 through a diode D2. A silicon controlled rectifier SCR 1 is connected between the junction of winding 22 and D2 and ground. Trigger coil 24 is coupled to the gate of SCR 1 and renders it conductive at an appropriate point in the engine cycle, which thereby clamps the junction voltage to the anode-cathode voltage drop of SCR 1, which is about 0.9 volts. Diode D2 raises the voltage necessary to render transistors T1 and T2 active to approximately 1.8 volts. This is the total voltage drop across D2 and between the base of T1 and the emitter of T2. When the junction voltage is greater than 1.8 volts, amplifier 26 is on. If it is less, the amplifier is full OFF.

At position line 1, the flywheel position at which pole shoe 14 is substantially opposite leg 16*b*, there is maximum flux density in stator 16 passing between legs 16*b* and 16*c*. Since $d\phi/dt$ is zero at this time, the reverse primary current flow drops to zero. As pole shoe 14 moves from this position, a positive voltage is generated on primary winding 18 and a positive voltage is produced on the anode of SCR 1 from the drive winding 22. When the anode voltage exceeds approximately 1.8 volts, T1 and T2 are drive into a high current saturated state since there is no base current limiting resistor. The primary current then rises due to the increasing primary voltage and drive coil signal and reaches its maximum at or near position line 2, which is approximately the position of flywheel 10 in FIGS. 1 & 2. Between positions 1 & 2, it can be seen that the trigger output rises from a negative value through zero to a positive value designated as pulse A. Pulse A is a product of the flux from pole shoe 14 that penetrates trigger coil 24 with decreasing density as the shoe is rotated towards the coil.

At position 2, the trigger coil output reaches a level designated trigger voltage as shown by the dotted lines. At this level the gate of SCR 1 conducts to turn SCR 1 on. The output circuit characteristics of SCR 1 are essentially those of a diode: A constant voltage of about 0.9 volts and low resistance. Thus consequently the anode is clamped to 0.9 volts when SCR 1 is ON. Thus T1 & T2 are back-biased and suddenly turned OFF causing the primary current flow to stop. Capacitor C1, however, acts as a time delay and allows the current to continue to flow for a brief moment after position 2. Thus the current gradually decays to the lower level depicted after position 2. The primary voltage that is developed is a product of the rate of current change in the primary winding. Hence, although the primary voltage has not been shown in FIG. 4, it is axiomatic that as the current decays rather quickly just after position 2, a self-induced voltage appears on the primary, which is stepped up in the secondary to produce the spark pulse that is shown.

The primary winding frequency response is substantially higher than the frequency response of the secondary winding. For well-known reasons, capacitor C1 lowers the frequency response of the primary circuit so that more of the induced primary voltage is transferred to the secondary winding. Thus, more energy is transferred to the secondary. A substantial portion of this energy would otherwise be lost in the higher components of primary voltage. Capacitor C1, therefore, serves to increase the secondary spark voltage.

SCR 1 stays on until the drive winding 22 voltage drops substantially to zero. This is a characteristic of silicon controlled rectifier. The self-induced voltage on primary winding 18 produces a voltage on drive winding 22 and this voltage gives rise to current through R3 and SCR 1. This is in addition to the current produced by the flywheel magnet movement creating the drive winding signal. The magnitude of this current is determined, of course, by resistor R3. The current level determines the amount of electromagnetic energy in the primary field at position 2, when the current is maximum, just before turn OFF, it is likewise equated. Thus, by increasing the current in the drive winding, more energy is transferred to it from the primary. This lowers the maximum available net energy that can be stored in the secondary field when the spark current is developed. Since the secondary voltage and energy are directly related through the above equation, R3 can be selected to develop enough current in drive winding 22 to hold the secondary voltage below the voltage which could cause damage to the secondary winding if it is accidently open circuited.

From the wave forms in FIG. 4 and also from FIG. 2, it can be appreciated that the position of trigger coil 24 on the edge of secondary winding 20 and drive winding 22 determines at what point in the rotation of rotor 10 it will reach the trigger voltage. That is, moving it away from the direction of arrow A will cause it to reach the trigger voltage at a point after position 2, thus retarding the timing. As engine r.p.m. increases, the rate at which the flux lines from magnet 12 permeate trigger coil 24 also increases. This increased rate of flux penetration increases $d\phi/dt$ and hence, the trigger level is reached before position 2 as engine r.p.m. increases. An ignition advance is thus achieved, whereby the spark occurs earlier in the engine cycle. This is necessary for economical and efficient engine operation due to the response time of the air/fuel mixture.

Attention is now directed to those wave forms showing the operation of the engine at and above the governed r.p.m. First it should be noted that the trigger output at low r.p.m. has a small positive pulse, designated pulse B that appears at position 1. This results from the field from the primary winding current that is flowing in the negative direction at that time. This interaction results from the field flux lines that penetrate trigger coil 24. Below the level designated "governed r.p.m.", pulse B is substantially less than the trigger voltage and consequently has no effect upon the operation of SCR 1. As engine r.p.m. increases, however, the rate at which the primary winding current changes also increases along with greater current. As a result, the level of pulse B rises. At the governed r.p.m., pulse B reaches the trigger level and triggers SCR 1 into its conductive state. However, at position 1, the primary current is small and close to zero so no appreciable self-induced primary voltage is generated. Hence, a spark is not generated and combustion does not take place. Engine operation above this r.p.m. is therefore impossible and over-revving is thereby prevented.

While that which has been described previously is the preferred embodiment of the present invention, from the analysis of its operation, it will be obvious to those skilled in the art that there are many possible modifications that can be made to the preferred embodiment, which nonetheless would still embrace its true scope and spirit of the invention. The following claims are intended, therefore to cover all such equivalents, modifications and variations.

I claim:

1. A breakerless magneto ignition system for an internal combustion engine wherein a flywheel containing a magnet assembly is rotated synchronously with the engine operation for the purpose of inducing a current in a primary coil and the current is switched OFF at a particular time in the engine cycle for the generation of an ignition spark on a secondary coil that is magnetically coupled to said primary coil, said breakerless magneto ignition system comprising:

a primary winding;

a secondary winding that is magnetically coupled to said primary winding;

a solid state switch for controlling the primary winding current flow;

first means for driving said switch into conduction in response to said rotating magnet assembly for turning the primary current ON at a first selected time;

second means for driving said switch into nonconduction in response to said rotating magnet assembly for turning the primary current OFF at a second selected time during the engine cycle, said means driving the current OFF at a third selected time in response to the magnet assembly rotating at a predetermined rate;

said second means including a trigger coil adapted to produce first and second pulses in response to the flywheel movement;

said first pulse rendering said solid state switch nonconductive when said engine is operated below said predetermined rate;

said second pulse rendering said switch nonconductive at and above said predetermined rate and occurring at a time in the engine cycle at which there is insufficient primary winding current flow through said switch to generate an ignition spark;

said pulses being in substantially constant phase relationship with each other.

2. The ignition system of claim 1, wherein, said second pulse increases in amplitude to a threshold voltage for rendering said solid state switch nonconductive as the engine operating rate increases.

3. The ignition system of claim 1 wherein said means turns the primary current OFF at said third selected time when the current is insufficient to produce a spark for sustained engine operation above said predetermined rate.

4. The ignition system of claim 3, wherein said means includes a drive coil for developing a control signal responsive to said rotating magnet assembly, said drive coil being connected to said switch, said switch being made conductive in response to said signal from said drive coil, said switch having a threshold level, said means driving said switch into nonconduction by lowering the input signal to said switch from said drive coil below the threshold level.

5. A breakerless magneto ignition system for an internal combustion engine wherein a flywheel containing a magnet assembly is rotated synchronously with the engine operation for the purpose of inducing a current in a primary coil and the coil is switched OFF at a particular time the engine cycle for the generation of an ignition spark on a secondary coil that is magnetically coupled to said primary coil, said breakerless magneto ignition system comprising:

a primary winding;

a second winding that is magnetically coupled to said primary winding;

a solid state switch for controlling the primary winding current flow:

first means for driving said switch into conduction in response to said rotating magnet assembly for turning the primary current ON at a first selected time;

second means for driving said switch into nonconduction in response to said rotating magnet assembly for turning the primary current OFF at a second selected time during the engine cycle, said means driving the current OFF at a third selected time in response to the magnet assembly rotating at a predetermined rate;

said means for driving said switch into nonconduction including a trigger coil, said primary winding and said secondary winding are wound on a magnetic frame, and said second means includes a trigger coil mounted adjacent to the lower edge of said secondary winding close to said primary winding and responsive in part to a magnetic field of said primary winding, in a distal relationship from said frame.

6. A magneto ignition system for an internal combustion engine wherein a rotor contains a magnet and adjacent pole shoes extending from the edge of the magnet to the edge of the rotor, the rotor is driven in synchronism with the engine operation to generate a current in a first winding, the current is stopped at a point in the engine cycle for the generation of an ignition spark on a second winding electromagnetically coupled to the first winding, the first and second windings are mounted on a stator having at least two legs extending to the edge of said flywheel to receive the field from said pole shoes, and a third coil is mounted on said stator for actuating a solid state switch in circuit with the primary to establish the current flow through the first winding, the improvement in said ignition system comprising:

a trigger coil mounted adjacent to the lower edge of said second winding, close to said first winding and responsive in part to a magnetic field of said first winding, and responsive in part to said magnet of said rotor, and substantially magnetically isolated from the field in said stator product by the flywheel rotation, for producing a first signal in response to said magnetic field effective only when said engine is operated above a predetermined rate, and a second signal responsive to said magnet, a second solid state switch in circuit connection with the trigger coil and the first solid state switch and actuated by said second signal to render the first solid state switch nonconductive when there is first coil current through said switch, whereby a spark pulse is produced by the second coil, said first signal rendering said first solid state switch nonconductive when there is insufficient first coil current through said switch to produce said spark.

7. The improvement described in claim 6, wherein, said second solid state switch is actuated by said trigger coil to an active state lowering the signal from the third coil below the signal level rendering the first switch conductive to establish said current, and wherein said second switch comprises, a silicon controlled rectifier, said signal is applied to the gate to render said rectifier conductive, the anode to cathode output circuit of said rectifier is in a substantially parallel circuit connection with the input of the first solid state switch, and the voltage drop from anode to cathode when said rectifier is conductive in less than the voltage needed to render the first switch conductive.

8. A breakerless magneto ignition system for an internal combustion engine wherein a flywheel containing a magnet assembly is rotated synchronously with the engine operation for the purpose of inducing a primary coil current and the current is switched OFF at a particular time in the engine cycle for the generation of an ignition spark on a secondary coil that is magnetically coupled to said primary coil, said breakerless magneto ignition system comprising:

a primary winding;

a secondary winding that is magnetically coupled to said primary winding;

a solid state switch for controlling the primary winding current flow;

means for driving said switch into conduction and nonconduction in response to said rotating magnet assembly for turning the primary current ON and OFF at first and second selected times during the engine cycle, said means driving the current OFF at a third selected time in response to the magnet assembly rotating at a predetermined rate;

said means including a trigger coil adapted to produce first and second pulses in response to the flywheel movement;

said first pulse rendering said solid state switch nonconductive when said engine is operated below said predetermined rate;

said second pulse rendering said switch nonconductive at and above said predetermined rate and occurring at a time in the engine cycle at which there is insufficient primary winding current flow through said switch to generate an ignition spark;

said pulses being in a substantially constant phase relationship with each other.

9. The ignition system of claim 8, wherein said second pulse increases in amplitude to a threshold voltage for rendering said solid state switch nonconductive as the engine operating rate increases.

10. The ignition system of claim 8, wherein said means turns the primary current OFF at said third selected time when the current is insufficient to produce a spark for sustained engine operation above said predetermined rate.

11. The ignition system of claim 10, wherein said means includes a drive coil for developing a control signal responsive to said rotating magnet assembly, said drive coil being connected to said switch, said switch being made conductive in response to said signal from said drive coil, said switch having a threshold level, said means driving said switch into nonconduction by lowering the input signal to said switch from said drive coil below the threshold level.

12. The ignition system of claim 8 wherein said means for driving said switch into nonconduction includes a trigger coil, said primary winding and said secondary coil are wound on a magnetic frame, and said trigger coil is adjacent to the lower edge of said secondary coil, close to said primary coil and responsive in part to a magnet field of said primary coil, in a distal relationship from said frame.

* * * * *

UNITED STATES PATENT AND TRADEMARK OFFICE

CERTIFICATE OF CORRECTION

PATENT NO. : 4,282,839

DATED : August 11, 1981

INVENTOR(S) : Richard D. Newberry, Elwin J. Brayley

It is certified that error appears in the above-identified patent and that said Letters Patent are hereby corrected as shown below:

Column 4, line 66, after "secondary" delete "drive";

Column 5, line 63, change "desingated" to --designated--.
Column 6, line 43, change "drive" to --driven--.

Signed and Sealed this

Ninth Day of February 1982

[SEAL]

Attest:

GERALD J. MOSSINGHOFF

Attesting Officer

Commissioner of Patents and Trademarks